United States Patent [19]

Morita et al.

[11] 4,145,868

[45] Mar. 27, 1979

[54] MOBILE TYPE AUTO-DOFFER PROVIDED WITH DOFFING DEVICE AND DONNING DEVICE FOR RING SPINNING MACHINE AND THE LIKE

[75] Inventors: Shin-ichi Morita, Nagoya; Yutaka Tanaka, Gifu, both of Japan

[73] Assignee: Howa Kogyo Kabushiki Kaisha, Nagoya, Japan

[21] Appl. No.: 879,943

[22] Filed: Feb. 17, 1978

[51] Int. Cl.[2] ..... D01H 9/10

[52] U.S. Cl. ..... 57/268; 57/275

[58] Field of Search ..... 57/52, 53, 54

[56] References Cited

U.S. PATENT DOCUMENTS

| | | | |
|---|---|---|---|
| 3,307,340 | 3/1967 | Nishii et al. | 57/53 |
| 3,344,594 | 10/1967 | Takemura et al. | 57/53 |
| 3,398,519 | 8/1968 | Haussmann | 57/52 |

*Primary Examiner*—John Petrakes

*Attorney, Agent, or Firm*—Haseltine, Lake & Waters

[57] ABSTRACT

A mobile type auto-doffer for ring spinning machines and the like consists of a doffing device and a donning device with mechanisms similar to those of a doffing device. The operation for doffing full bobbins may be carried out by utilizing the doffing device, and the operation for donning fresh bobbins may be carried out by utilizing the donning device. During the doffing operation, a plurality of full bobbins is simultaneously transported from the spindles to the pegs disposed between the spindle rail of the spinning machine and the surface of the floor of a spinning plant. During the donning operation, the same number of fresh bobbins as that of a full bobbins is simultaneously transported from the pegs to the spindles. Both of the above-mentioned ways of transporting bobbins may be carried out by moving the full bobbins or the fresh bobbins along separate vertical passages, respectively, i.e., one passage being disposed farther from the row of spindles than the other passage. The vertical movement of bobbins can be induced by the sliding movement of swing arms along a corresponding spline shaft. The horizontal movement of the doffing head of the doffing device as well as the horizontal movement of the donning head of the donning device can be induced by the swinging movement of the swing arms. The horizontal and vertical movements of the doffing head of the doffing device and the horizontal and vertical movements of the donning head of the donning devices can be controlled and effected by means of hydraulic mechanisms, respectively. In addition, the action of holding full or fresh bobbins by means of a plurality of cop holders mounted on both the doffing and donning heads, can also be controlled and effected by means of hydraulic mechanisms.

9 Claims, 12 Drawing Figures

MOBILE TYPE AUTO-DOFFER PROVIDED WITH DOFFING DEVICE AND DONNING DEVICE FOR RING SPINNING MACHINE AND THE LIKE

BACKGROUND OF INVENTION

The present invention relates to a mobile type auto-doffer, for doffing a plurality of full bobbins from a row of spindles mounted on a spinning machine or a twisting frame and the like, for mounting full bobbins onto a row of pegs disposed between a spindle rail of the machine and a surface of the floor of the spinning plant, for dismounting the same number of fresh bobbins mounted on that row of pegs, and for donning fresh bobbins onto the row of spindles, wherein conveyance of full bobbins after being doffed and conveyance of fresh bobbins to be donned can be both carried out simultaneously.

Generally, a row of pegs is disposed at the region underneath the spindle rail of the spinning machine. Therefore, when the above-mentioned doffing and donning operations are carried out, it is necessary to move the doffing head with cop holders and to move the donning head with other cop holders vertically as well as horizontally. When conveyance of full bobbins after the doffing operation and conveyance of fresh bobbins before the donning operation are carried out simultaneously, it is also necessary to select moving vertical passages for the doffing and donning heads such that one passage is disposed at the outside region of the other passage, so that when the heads are being moved vertically as well as horizontally, there is no chance for one head to obstruct the movement of the other head. Due to this requirement for moving the doffing and donning heads, all of the present auto-doffers of this type use vertically moving members which move along vertical shafts disposed on both sides of an auto-doffer. Furthermore, on such moving members, a doffing or donning head is slidably supported and horizontally guided, so that either head can be moved toward or away from the spindle.

One doffer of this type is shown in Japanese Patent Application Laid-open No. Sho 51-139934 (Japanese Patent Application No. Sho 50-63433). The doffing or donning head of this type of doffer has two extended legs, which are disposed at both end portions of either head, respectively, in such a way that both legs are perpendicular to the head. In addition, rack teeth are provided on each of the two legs. Therefore, when turning a pinion rotatably mounted on a vertically moving member, either head can be moved horizontally because the pinions are caused to mesh with the rack teeth on the legs.

Another doffer of this type is shown in Japanese Patent Application Laid-open No. Sho 51-112935 (Japanese Patent Application No. Sho 50-37883). A doffing or donning head of this type of doffer also has two extended legs, which are also disposed at both ends of either head, respectively, in such a way that they are perpendicular to the head. Furthermore, two follower rollers are provided on the legs at the rear ends thereof, respectively. During the time when the head is moving vertically, the head can also be moved horizontally due to the guidance of the slanted surfaces on the vertical plate cams, because the follower roller is always in contact with the slanted surface by urging the roller upon the slanted surface by means of a spring. The legs of the head of the doffing device are disposed in such a way that such legs are arranged outside of the legs of the other head of the donning device, or vice versa.

One drawback of these types of auto-doffers is that, due to the arrangement of the legs as mentioned above, the required longitudinal length of the doffer becomes inevitably long. With respect to the width of the doffer, such width tends to also be quite long, because within such width the long leg must slide horizontally along the horizontal guide of the vertical moving member and in a direction toward as well as in a direction away from the spindle. Accordingly, this wide doffer sometimes creates difficulties if used with spinning machines, because the doffer must be moved along a narrow alley situated between the adjacent spinning machines. Another drawback is due to the fact that since the head having such a long leg is always hanging over from the front end of a support for the leg, difficulties are caused when the head is being rested correctly at its given position. Accordingly, quick doffing as well as quick donning cannot be expected. In addition, the smooth movement of the leg moving within the horizontal guide is reduced when fly waste accumulates in the horizontal guide.

If the driving system of the doffing or donning device is a mechanical driving system which uses gears, racks, pinions, screws, etc., to convey the turning movement of a motor to the movement of the heads, it is necessary then to combine such a mechanical system with a complicated electrical controlling means for resting the heads correctly at their given positions. However, as a result of this requirement the construction of the doffer becomes inevitably complicated, and the possibility of operational failures occuring is therefore increased. Furthermore, the size of the auto-doffer is enlarged, thereby causing the maintenance and control of the doffer to be difficult. Due to these drawbacks, the above-described auto-doffers cannot yet be practically used in a spinning mill.

An object of the present invention is to provide an auto-doffer with an overall small size and a light weight. Furthermore, it is also an object of the present invention to accelerate the doffing operation as well as the donning operation.

SUMMARY OF THE INVENTION

The mobile type auto-doffer of the present invention comprises a doffing device, a donning device with mechanisms similar to those of the doffing device, and a driving mechanism for driving each of the two devices. The doffing device comprises a doffing head provided with a given number of cop holders, two pinions rotatably mounted on the doffing head at both end regions of the head, a pair of rack bars arranged in parallel, which always mesh with the pinions and which are guided and slidably supported on the head, and a pair of swing arms, each with a rack bar pivotably mounted thereon, wherein the arms are connected angularly with vertical spline shafts supported on the walls of the doffer, respectively, so as to be slidable on the vertical spline shafts. Means for inducing horizontal movement of the doffing or donning head is provided on this auto-doffer. Such means consists of a common driving mechanism for driving both vertical spline shafts, each of which is respectively arranged outside of each of the two end faces of the doffing or donning head, respectively, so that the vertical spline shafts can be rotated by such means around their axes in opposite directions. In this arrangement of the doffing and donning devices, both devices are so constructed that, when viewed from above, the doffing head and the donning head are overlapped together when both are in their foremost positions. However, the doffing device and the donning device are not overlapped together when both are in their rearmost positions, because their rearmost positions are of different distances from the spindle, respectively. As a result of the above-described arrangement of the doffing device and the donning device, when both devices are in their rearmost positions the doffing head as well as the donning head can occupy the narrow area located between the two vertical spline shafts. Accordingly, it is possible to design an auto-doffer with a shortened longtitudinal length and with a narrow width.

Because the doffing head or the donning head is pivotably connected to a pair of swing arms, the horizontal movement of the doffing head or donning head induced by the swing movement of the swing arms, which is caused by the rotation of the spline shaft at a small angle, is smooth. Therefore, the doffing and donning operations can be speedily carried out by using these doffing and donning devices.

The arrangement of the doffing device and donning device as mentioned above causes the area occupied by such devices to be narrow in the widthwise direction. By providing a driving gear which meshes with a driven gear on the spline shaft of the doffing device and also with a similar driven gear on the spline shaft of the donning device, both of the vertical spline shafts can be turned simultaneously by the driving gear, which is driven by a common driving mechanism.

Furthermore, since the horizontal movements of the doffing and donning heads as well as the vertical movements thereof are induced by means of respective hydraulic means, the speed control of the doffing and donning operations within one cycle can be carried out easily, and also the moving inertia of the heads can be easily controlled by switching over a valve provided on the hydraulic mechanism. As a result, the doffing and donning operations can be speeded up, and the positioning of the doffing head as well as the positioning of the donning head at their given resting positions can be carried out accurately. By using the above-mentioned hydraulic mechanism, damages to the auto-doffer as well as to the spinning machine due to failure of the cop holders to hold the bobbins by the cop holders can be prevented, because the control of the driving force generated by the hydraulic mechanism is easy.

In addition to this, in the arrangement of the cop holder, the hydraulic cylinder and the full or fresh bobbin to be held by such cop holder, since one cop holder can hold one bobbin by the action of the hydraulic cylinder, a plurality of cop holders can be used to simultaneously hold a plurality of full or fresh bobbins. Even in the event that the top of the full or fresh bobbin is deformed, or in the event that fly waste is accumulated thereon, or in the event that the dimension of such top is irregular, the irregular bobbin can be held by the cop holder like the bobbin of a regular configuration. As a result, the bobbin can always be held correctly by utilizing the cop holder of the present invention.

Other objects and features of the present invention will appear more clearly from the following description of the embodiments of the invention and from the appended drawings in which:

DESCRIPTION OF THE PREFERRED EMBODIMENTS

Figure 1:
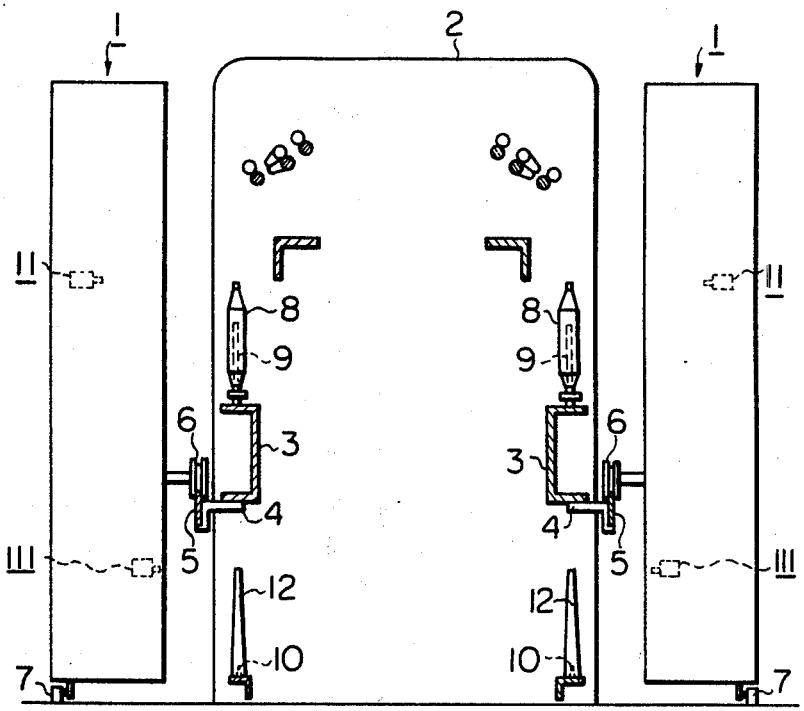
FIG. 1 is a skeleton sectional view showing the relative arrangement of a spinning machine and two mobile type auto-doffers disposed on both sides of the spinning machine, respectively.

In FIG. 1, a spinning machine 2 is provided with two rows of pegs disposed between the underside of a spindle rail of the spinning machine and the surface of the floor of a spinning plant. The axles of the pegs are disposed in such a way so as to coincide with the axles of spindles mounted on the spinning machine, respectively. However, the arrangement of the pegs should not be restricted to the arrangement as described above, as long as a peg and a spindle are disposed within a common vertical plane which is perpendicular to the longitudinal direction of the spinning machine.

Two of the mobile type auto-doffers 1 are disposed on both sides of the spinning machine 2, respectively, so that they can be moved along the machine 2 on the surface of the floor of a spinning plant by means of floor wheels 7, and being guided by guide rails 5 mounted on the spindle rails 3, due to the engagement of guide rollers 6 with the guide rails 5. Each of the mobile type auto-doffers 1 is displaced from one position to a next position at a distance which is equal to the length of the spindle pitch multiplied by the number of full bobbins to be doffed or the number of fresh bobbins to be donned simultaneously by means of the doffer. Such displacement of the auto-doffer at the given distance takes place after every cycle of the auto-doffer operation is completed. Such displacement is induced by means of a hydraulic motor which is not shown in FIG. 1. After the displacement at the given distance is completed, the auto-doffer is stopped and rested at the position where full bobbins on the spindles and fresh bobbins on the pegs are doffed and donned, respectively. The cycle of the auto-doffer operation is commenced at one end of the spinning machine and repeated until all of the full bobbins are doffed from and all of the fresh bobbins are donned onto the spindles on the spinning machine.

The mobile type auto-doffer 1 of the present invention is provided with a doffing device 11 as well as with a donning device 111. The doffing device 11 is used to remove a full bobbin 8 from a spindle 9 and to insert the full bobbin onto a peg 10. The donning device 111 is used to pick up a fresh bobbin 12 from a peg 10 and to mount the fresh bobbin onto the spindle 9.

Figure 3:
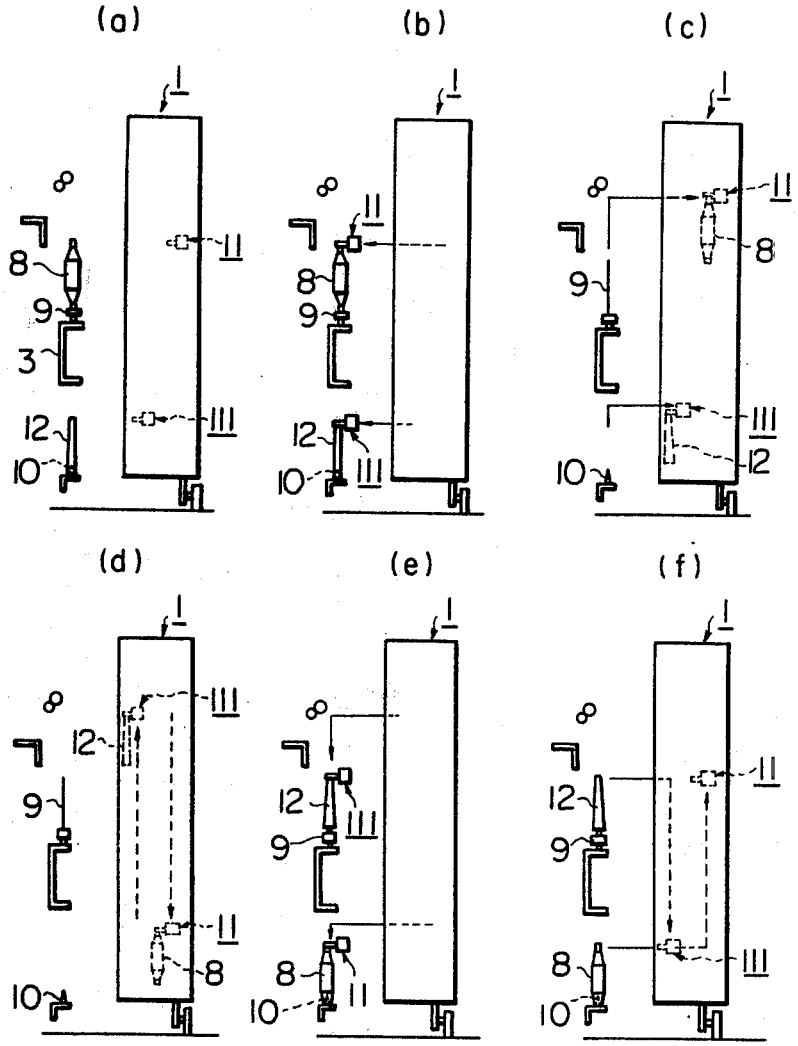
FIG. 3 shows skeleton views of the six different steps within one operational cycle of the auto-doffer of the present invention.

The sequences of the movements of the doffing device 11 as well as the sequences of the movements of the donning device 111 are shown in FIG. 3.

When a full bobbin 8 to be doffed is mounted on a spindle 9 and a fresh bobbin 12 is mounted on a peg 10, as shown in FIG. 3*a*, the doffing device 11 and the donning device 111 housed within the auto-doffer 1 are in their initial positions, respectively.

The doffing device 11 and the donning device 111 are moved simultaneously in a horizontal direction toward the full bobbin 8 and the fresh bobbin 12, respectively, as shown in FIG. 3*b*. By this horizontal movement, the doffing device 11 can clamp the top of the full bobbin 8 and the donning device 111 can clamp the top of the fresh bobbin 12.

Both the doffing device 11 together with the full bobbin 8 and the donning device 111 together with the fresh bobbin 10 are lifted vertically by their respective drive means, and then moved by the above-described horizontal movement away from the spindle 9 and the peg 10, respectively, as shown in FIG. 3*c*. In this case, the distance in which the doffing device 11 is moved horizontally is longer than that of the donning device 111.

The doffing device 11 together with the full bobbin 8 is moved down vertically, while at the same time, the donning device 111 together with the fresh bobbin 12 is moved up vertically, as shown in FIG. 3*d*.

Then, both the doffing device 11 and the donning device 111 are moved horizontally to the position where the doffing device 11 can insert the full bobbin 8 onto the peg 10 and to the position where the donning device 111 can mount the fresh bobbin 12 onto the spindle 9, respectively, as shown in FIG. 3*e*. Thereafter, both devices are simultaneously moved downward so that the fresh bobbin 12 can be mounted onto the spindle 9 and that the full bobbin 8 can be held by the peg 10. After the above-described movements are finished, the full bobbin doffing operation and the fresh bobbin donning operation are completed.

Finally, the donning device 111 and the doffing device 11 are moved toward the inside of the auto-doffer 1, respectively, and the donning device 111 is then moved down vertically while the doffing device 11 is moved up vertically, as shown in FIG. 3*f*, so that both the doffing device 11 and the donning device 111 are returned to their initial positions as shown in FIG. 3*a*. Thus, one cycle of the operation of this auto-doffer is completed.

As the auto-doffer is provided with a plurality of cop holders, therefore, a predetermined number of full bobbins 8 and a corresponding number of fresh bobbins 10 can be doffed and donned simultaneously. After completion of one cycle of the operation the auto-doffer is again activated to move along the spinning machine, until it comes to a position which is exactly in front of the position where the next sets of full bobbins to be doffed and fresh bobbins to be donned are situated.

The constructions of this doffing device 11 and donning device 111 are almost identical.

Figure 2:
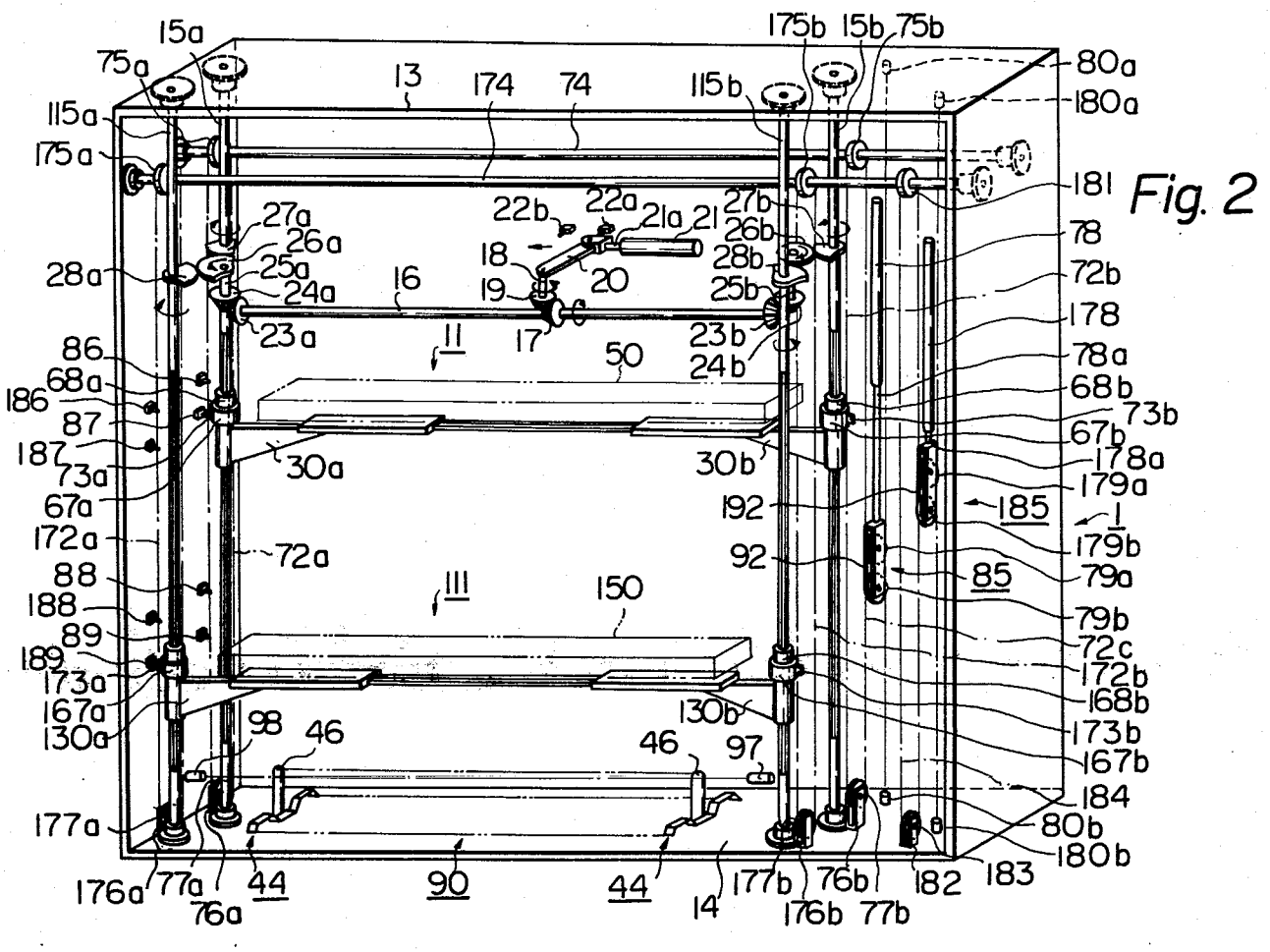
FIG. 2 is a perspective view of one embodiment of the auto-doffer of the present invention.

Four vertical spline shafts 15*a*, 15*b*, 115*a*, 115*b* are rotatably and vertically supported by means of bearings mounted on a top wall 13 and a bottom wall 14 of the doffer, as shown in FIG. 2. The shafts are arranged symmetrically in two pairs 15*a*, 115*a* and 15*b*, 115*b*. However, the distance between the row of spindles and the shaft 15*a* is the same as the distance between the row and the shaft 15*b*. The distance between the row of spindles and the shaft 115*a* is the same as the distance between the row and the shaft 115*b*.

A horizontal shaft 16 is disposed between the pair of vertical spline shafts 15*a*, 115*a* and the pair of vertical spline shafts 15*b*, 115*b* in such a way that the shaft 16 is caused to extend between both pairs of vertical spline shafts. One bevel gear 17 is fixedly mounted at the middle of the horizontal shaft 16 in order for this shaft 16 to be turned in a clockwise or counterclockwise direction by means of a hydraulic cylinder 21 via a connecting mechanism which consists of one bevel gear 19, a vertical shaft 18, one arm 20 and a piston rod 21*a* of the hydraulic cylinder 21, as shown in FIG. 2. The displacement of the piston rod 21*a* can be detected and limited by means of two limit switches 22*a*, 22*b* arranged in parallel to the axis of the cylinder 21. On both ends of the horizontal shaft 16, two bevel gears 23*a*, 23*b* are fixedly mounted. The vertical spline shafts 15*a*, 115*a*, 15*b*, 115*b* are provided with the sector gears 27*a*, 28*a*, 27*b*, 28*b*, respectively. The sector gears 27*a*, 28*a* are both meshed with a sector gear 26*a*, respectively, while the sector gears 27*b*, 28*b* are both meshed with a sector gear 26*b*, respectively. Through these two gearing arrangements, the turning motion of the horizontal shaft 16 is transported to the two pairs of vertical spline shafts 15*a*, 115*a* and 15*b*, 115*b* via a bevel gear 24*a* together with a vertical shaft 25*a* and via a bevel gear 24*b* together with a vertical shaft 25*b*, respectively, as shown in FIG. 2. This means that the two pairs of vertical spline shafts 15*a*, 115*a* and 15*b*, 115*b* can be turned in opposite directions while the turning angles of the vertical spline shafts 15*a*, 15*b* are maintained the same. The turning angles of the vertical spline shafts 115*a*, 115*b* are also maintained the same.

A pair of swing arms 30*a*, 30*b* is mounted on the vertical spline shafts 15*a*, 15*b*, respectively, while another pair of swing arms 130*a*, 130*b* is mounted on the vertical spline shafts 115*a*, 115*b*, respectively. Furthermore, these swing arms are disposed on the vertical spline shafts in such a way that all of the outer ends of these swing arms are directed toward the center of the doffer, respectively. The disposition of the pair of swing arms 30*a*, 30*b* is such that the arms can both turn by the same angle with respect to the vertical plane passing through the axle of the vertical spline shafts 15*a*, 15*b*, while the disposition of a pair of swing arms 130*a*, 130*b* is also the same as that of the case wherein the vertical plane passes through the axle of the vertical spline shafts 115*a*, 115*b*.

As the swing arms 30*a*, 30*b*, 130*a*, 130*b* are coupled angularly with the vertical spline shafts 15*a*, 15*b*, 115*a*, 115*b*, respectively, by means of the spline coupling mechanism, each of the swing arms can thus be moved along each of the vertical spline shafts. However, each of the above-mentioned arms cannot be displaced angularly with respect to each of the above-mentioned vertical spline shafts. Therefore, the swing angle of each of the swing arms is precisely the same as that of the turning of the vertical spline shaft. Because the turning of the two vertical spline shafts 15*a*, 15*b* is induced by a common horizontal shaft 16, the horizontal angles of the swing arms 30*a*, 30*b* from the vertical plane passing through the vertical spline shafts 15*a*, 15*b* are maintained exactly the same even though the vertical spline shafts 15*a* and 15*b* are turning in opposite directions. This relation is also the same for the case of swing arms 130*a*, 130*b*.

At the ends of the swing arms 30*a*, 30*b*, two stud pins 31 are pivotably mounted, respectively. Either one of the rack bars 32*a*, 32*b* may be fixedly connected to the top of either one of the stud pins 31 at its one end, while the rack bars 32*a*, 32*b* have long portions respectively extending from the above-described end. On the long extended portions of the rack bars, two sets of rack teeth are formed, one set at the root position and the other set at the free end portion of the bars. Two rack bars 32*a*, 32*b* are also disposed in such an arrangement that the two bars are parallel to each other. However, both sets of rack teeth of the rack bars 32*a*, 32*b* are always facing each other. Two pinions are arranged between the rack bars 32*a*, 32*b*, in such a way that the pinions 35 are always meshing with both sets of rack teeth of the rack bars 32*a*, 32*b*, as shown in FIG. 4.

Figure 4:
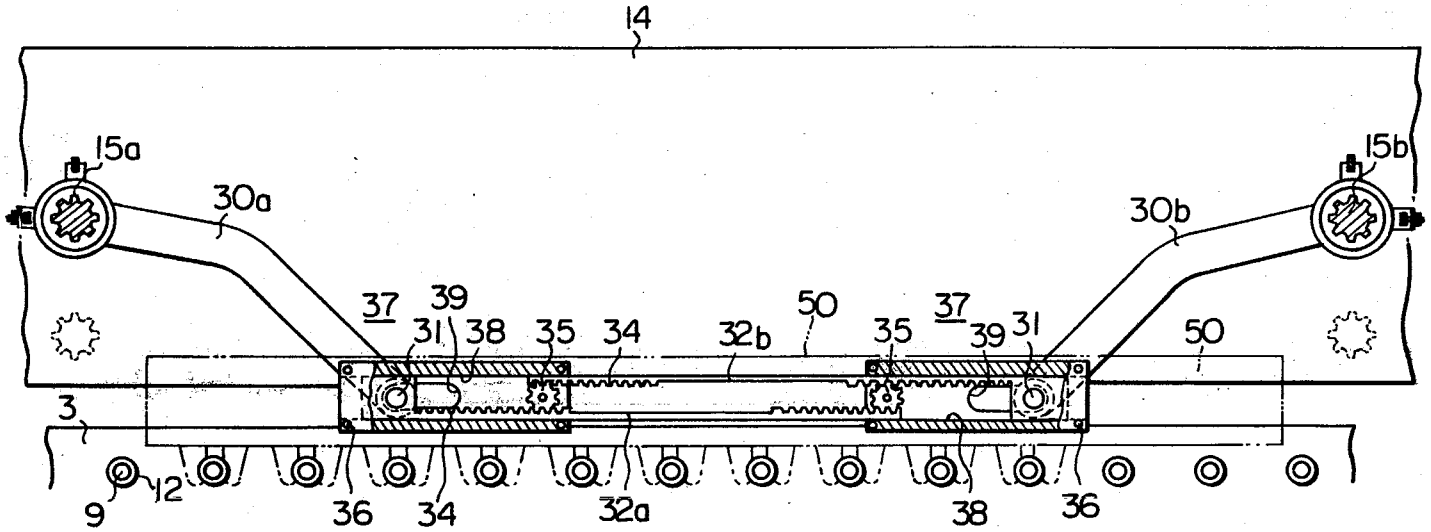
FIG. 4 is a plan view of the doffing device at its doffing position, wherein the donning device is not shown.

Two supporting members 37 shown in FIG. 4 are mounted on the pair of rack bars 32*a*, 32*b* in such away that the rack bars are inserted into guide openings (not shown) provided with two guide surfaces 38 formed on the supporting members 37. On each of the support members 37, one pinion 35 is rotatably mounted at a position which is located on the center line of the guide openings, as shown in FIG. 4. Both of the supporting members 37 are fixedly attached onto both ends of the bottom surface of a doffing head 50 of the doffing device 11 by means of a plurality of studs 36.

Figure 5:
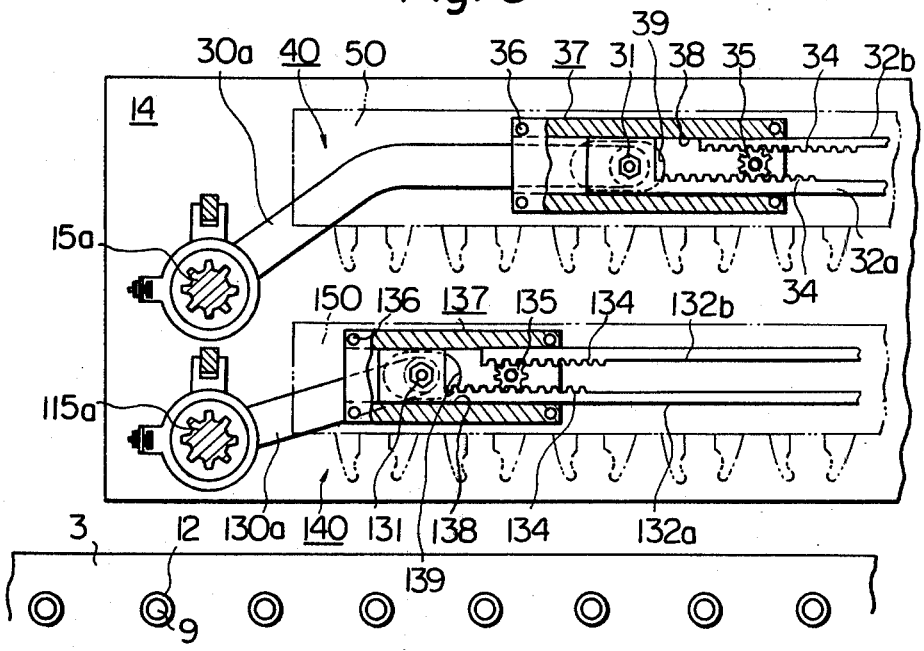
FIG. 5 is a partial plan view of the doffing and donning devices, wherein the heads thereof are both removed and ready for start of operation, respectively.

Similarly, as shown in FIG. 5, two supporting members 137 are also fixedly mounted on a donning head 150 of the donning device 111.

Since the horizontally moving devices 40, 140 for the doffing device 11 and donning device 111 are constructed as mentioned hereinabove, when the horizontal shaft 16 is turned, both stud pins 31 on the swing arms 30*a*, 30*b* will be brought close to, or separated from each other, due to the angular swing movement of the stud pins within a common horizontal plane, via the same angular swing movements of the swing arms 30*a* and 30*b* with respect to the common vertical plane passing through the axles of the vertical spline shafts 15*a* and 15*b*. As a result, the doffing head 50 is caused to move toward or to move away from the row of spindles, while maintaining a parallel distance from the spindle row. Maintaining such a parallel distance relationship can be guaranteed by means of a mechanism consisting of the two rack bars 32*a*, 32*b*, and the two pinions 35 which are always meshing with the rack teeth on these two rack bars. Accordingly, the center of the doffing device 11 can be moved along the line which is perpendicular to the row of spindles.

Figure 6:
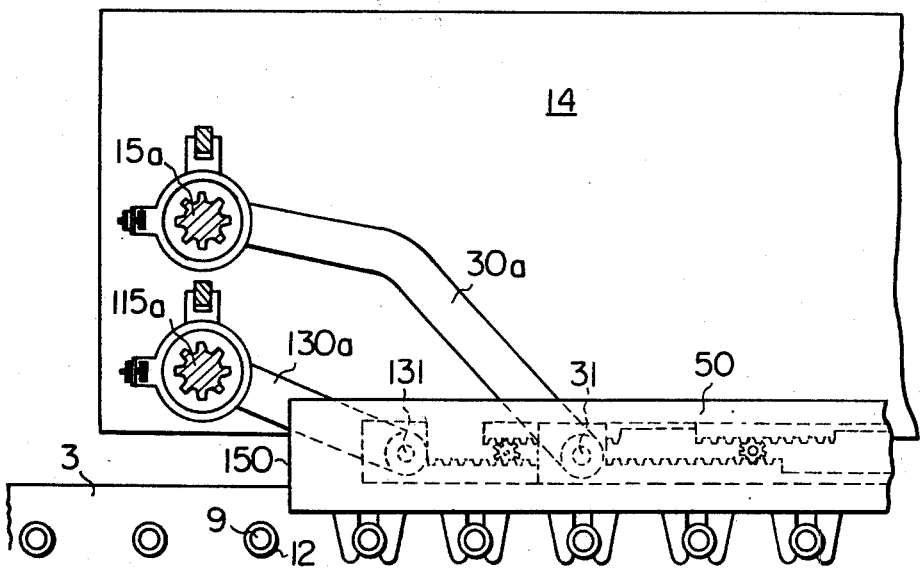
FIG. 6 is a partial plan view of the doffing and donning devices, at their operating positions, respectively.

As shown in FIGS. 5 and 6, the horizontal displacing distance of the doffing head 50 is always different from the horizontal displacing distance of the donning head 150. In the embodiment as shown in FIGS. 5 and 6, the swing angle of the swing arm 30*a* is greater than that of the swing arm 130*a*.

The two above-mentioned conditions are due to the fact that, as shown in FIG. 2, the gearing ratio of the sector gear 26*a* to the sector gear 27*a* is different from the gearing ratio of the sector gear 26*a* to the sector gear 28*a*. The ratio of the sector gear 26*a* to the sector gear 27*a*, of course, must be the same as the ratio of the sector gear 26*b* to the sector gear 27*b*. Similarly, the ratio of the sector gear 26*a* to the sector gear 28*a* must be the same as the ratio of the sector gear 26*b* to the sector gear 28*b*.

As mentioned before, the swing arms 30*a*, 30*b*, 130*a*, 130*b* are mounted on the vertical spline shafts 15*a*, 15*b*, 115*a*, 115*b*, respectively, by means of the spline coupling mechanism described hereinafter.

Figure 7:
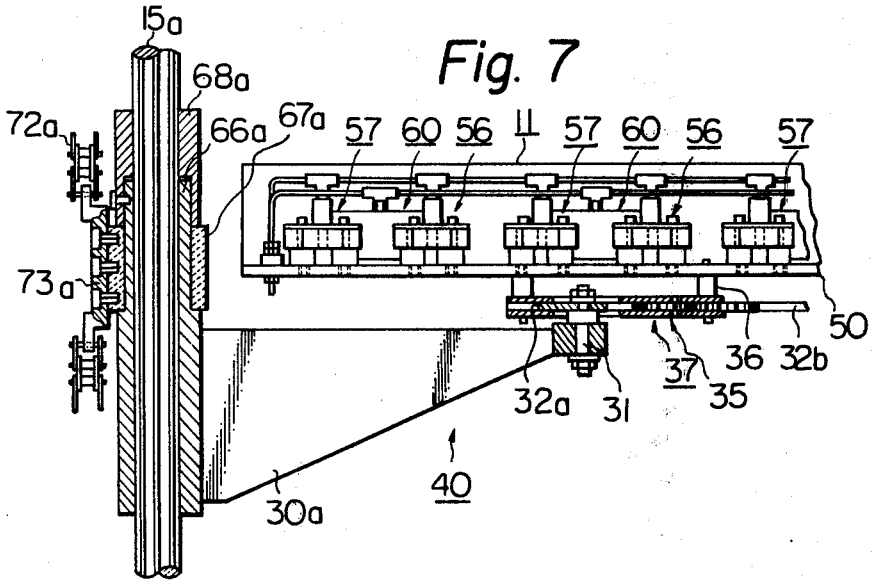
FIG. 7 is a sectional front view of a doffing device together with a horizontally moving device thereof.

As shown in FIG. 7, this coupling mechanism consists of a plurality of spline grooves located on the vertical spline shaft 15*a* and a spline hole corresponding to the spline shaft 15*a*, which hole is provided on a stepped part 66*a* of the swing arm 30*a*, wherein a set hoop 68*a* is accommodated on the stepped part and provided with a spline hole similar to the hole of the stepped part. Accordingly, the stepped part 66*a* together with the set hoop 68*a* can slide along the longitudinal direction of the vertical spline shaft 15*a*. By the vertical movement of the stepped part 66*a* along the vertical spline shaft 15*a*, the doffing head 50 can be moved upwardly or downwardly.

Figure 8:
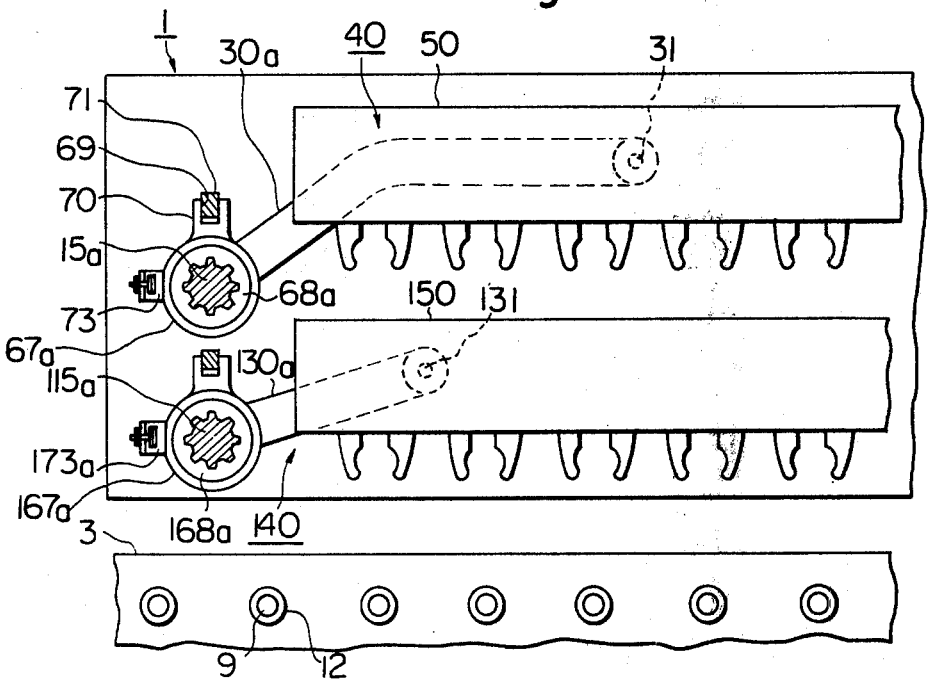
FIG. 8 is a plan view of doffing and donning devices, at their vertically moving positions, respectively.

As shown in FIGS. 7 and 8, an annular member 67*a* is loosely mounted on the top portion of the stepped part 66*a*. The annular member 67*a* has a projection 70 with a cut-out groove projected therefrom, which groove is engaged with a guide rod 71. As a result of this arrangement, the annular member 67*a* can be guided by the guide rod 71, which is disposed in parallel with respect to the vertical spline shaft 15*a*. Accordingly, a similar mechanism is also used for operating the vertical spline shaft 115*a*.

A connecting piece 73*a* is fixedly mounted on the annular member 67*a*, and both ends of a chain 72*a* are connected onto the lower portion and the upper portion of the connecting piece 73*a*, respectively. The chain 72*a* is extended over an upper chain wheel 75*a* on a horizontal shaft 74 which is rotatably supported by means of both side walls of the auto-doffer, and also over a lower chain wheel 77*a* supported on the bottom wall 14 of the auto-doffer, as shown in FIG. 2.

As shown in FIG. 2, a connecting piece 73*b* is fixedly mounted on an annular member 67*b*, and an end of a chain 72*b* is connected to the upper portion of the connecting piece 73*b*, while the opposite end of the chain is fixedly supported by the top wall 13 of the auto-doffer 1 by means of an adjusting screw 80*a* after the chain 15 extended over a chain wheel 75*b* mounted on the horizontal shaft 74, and also over a chain wheel 79*a* provided for the vertical movement inducing device 85. An end of another chain 72*c* is connected to the lower portion of the connecting piece 73*b*, while the opposite end of the chain 72*c* is fixedly supported by the bottom wall 14 of the auto-doffer 1 by means of another adjusting screw 80*b* after the chain is extended over a lower chain wheel 77*b* supported on the bottom wall 14 by means of a bracket 76*b*, and also over another chain wheel 79*a* provided for the vertical movement inducing device 85.

Such a vertical movement inducing device 85 consists of the two chain wheels 79*a* and their supporting member 92, on which member two chain wheels are rotatably supported at a given distance between them.

The supporting member 92 is made integrally with a piston rod 78*a* of a hydraulic cylinder 78 which is arranged vertically and mounted on the side wall of the auto-doffer 1.

A vertical movement initiating device 185 for the donning head 150, which is similar to the vertical movement initiating device 85 of the doffing head 50, is also disposed between the device 58 and the side walls of the auto-doffer 1. This device 185 consists of one chain 184, two adjusting screws 180*a* and 180*b*, one hydraulic cylinder 178 provided with one piston rod 178*a*, in which a supporting member 192 holding two chain wheels 179*a* is fixedly mounted. Furthermore, a chain 184 is extended from the adjusting screw 180*a* to a screw 180*b* after being extended over a chain wheel 181 on a horizontal shaft 174 and over a chain wheel 183 supported on the bottom wall 14 of the auto-doffer 1 by means of a bracket 182.

As shown in FIG. 2, on the auto-doffer of the present invention, a plurality of limit switches 86, 87, 88, 89, 186, 187, 188 and 189 for detecting the respective heights of the doffing device 11 as well as for detecting the respective heights of the donning device 111 are provided, so that detections by means of such limit switches can be used for controlling the operations of the hydraulic cylinders 60, 78 and 178.

Figure 9:
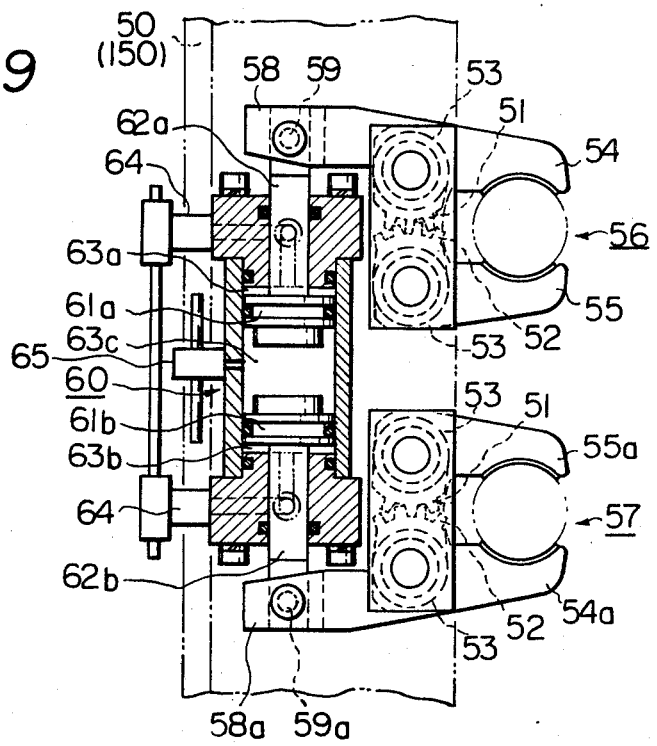
FIG. 9 is a plan view of cop holders.
Figure 10:
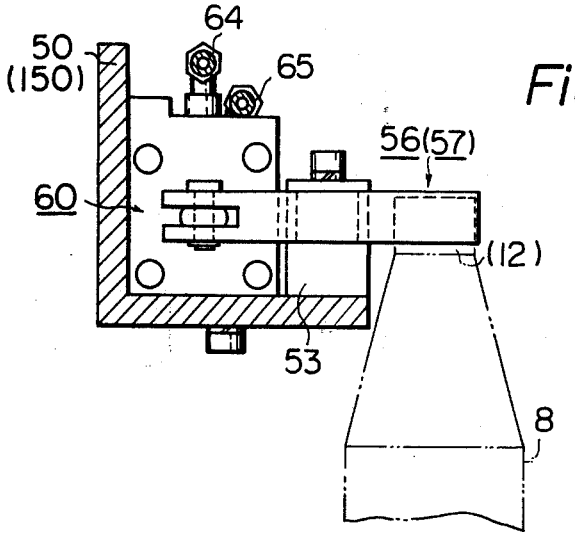
FIG. 10 is a side view of the cop holders as shown in FIG. 9.

As shown in FIGS. 9 and 10, a plurality of cop holder sets are mounted on the doffing head 50 of the doffing device 11 and on the head 150, which is similar to the doffing head 50 of the doffing device 11, and disposed with a given distance between adjusent sets. Each set of cop holders consists of two cop holders 56 and 57 arranged at a distance equal to the distance between two adjacent spindles on the spinning frame. Each cop holder 56 or 57 has an external finger 54 or 54*a* provided with an acting arm 58 or 58*a*, which is pivotably mounted on the stud 53 fixed on the body of the cop holder 56 or 57. A sector gear 51 is provided at its pivoting center. An internal finger 55 or 55*a* is pivotally mounted on the body of the cop holder 56 or 57 by means of another stud 53. In addition, a sector gear 52, which is always meshing with the sector gear 51, is provided on the external finger 54 or 54*a*. A hydraulic cylinder 60 provided with the two pistons 61*a* and 61*b* is arranged between the two cop holders 56 and 57. A center cavity 63*c* within the hydraulic cylinder 60 is located between the two pistons 61*a* and 61*b*. Two side cavities 63*a* and 63*b* of the hydraulic cylinder are also formed between the pistons 61*a* and 61*b* and the end walls of the cylinder, respectively. By means of the connecting pins 59 and 59*a*, the piston rod 62*a* or 62*b* of the piston 61*a* or 61*b* is pivotably connected to the end of the acting arm 58 or 58*a*. The center cavity 63*c* as well as two side cavities 63*a* and 63*b* are respectively connected to the hydraulic source via piping 64 or 65.

Figure 11:
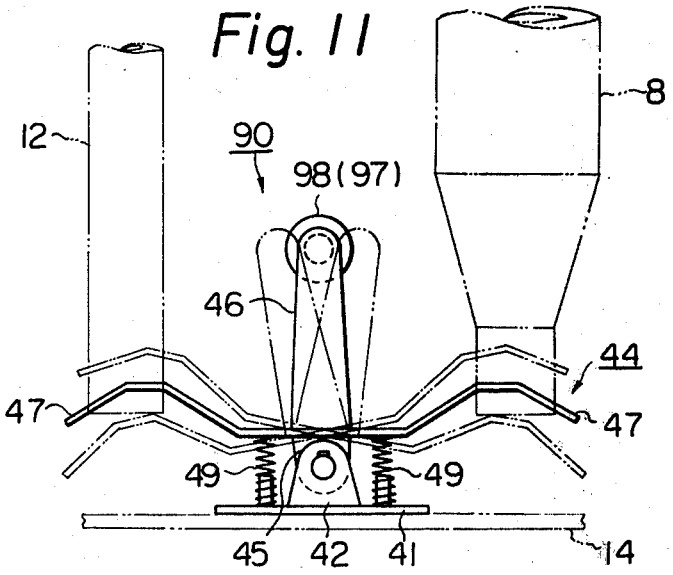
FIG. 11 is a side view of one embodiment of the detecting device.
Figure 12:
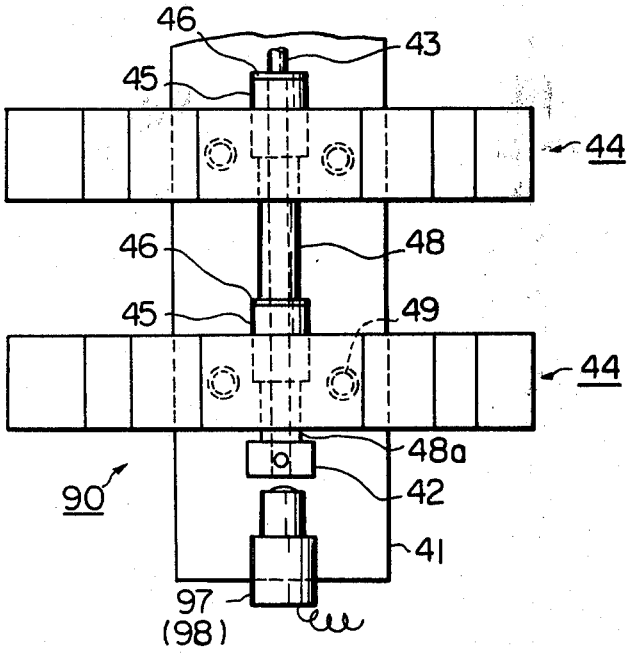
FIG. 12 is a plan view of the detecting device as shown in FIG. 11.

A detecting device 90, for detecting the condition wherein the cop holders fail to hold any bobbins on both the doffing head 50 and the donning head 150, is arranged on the bottom wall 14 of the auto-doffer 1 in such a way that the detecting device is situated between both sides of the vertical spline shafts of the doffing device 11 and the donning device 111. As shown in FIGS. 11 and 12, the same number of detecting pieces 44 as the number of cop holders 56 and 57 on the doffing head 50 or donning head 150 are provided on the detecting device. The detecting member 44 consists of an upwardly projecting finger 46 and two detecting wings 47 which are disposed on both sides of the finger 46, respectively. The finger 46 provided with a boss 45 is pivotably mounted on the bottom wall 14 of the auto-doffer 1 by means of a bracket 42 and a horizontal shaft 43. A distance collar 48 is located between two adjacent bosses 45, so that the detecting piece can be arranged in such a way that each of the detecting members 44 and each of the cop holders 56 and 57 are disposed in a common vertical plane which is perpendicular to the longitudinal axis of the spinning machine, wherein the distance between two adjacent detecting members 44 is the same as that between two adjacent cop holders as well as the same as the distance between two adjacent spindles.

It is necessary to dispose the detecting wings 47 in their given positions, in which position each wing can be pushed downwardly by the bottom of a fresh bobbin 12 or a full bobbin 8 as shown in FIG. 11, during the time, as shown in FIG. 3, when the fresh bobbin is being conveyed from a peg 10 to a spindle 9 by means of the donning device 11, or when the full bobbin 8 is being conveyed from a spindle 9 to a peg 10 by means of the doffing device 11, and in which position the wings are disposed and arranged at the middle part of the passages of the fresh bobbins and full bobbins. Two springs 49 are arranged between a base 41 and the detecting wings 47 for maintaining the wings 47 on a common horizontal plane during the time when the wings are in their normal condition.

A light source 97 and a photocell 98 are arranged at almost the same height as the top portion of the upwardly projecting finger 46, in such a way that a light beam emerging from the light source can be interrupted by the finger 46 and prevented from entering into the photocell 98 when the doffer operation is abnormal.

The functional sequence of the auto-doffer operation of the present invention will be described in detail hereinafter. During the spinning operation of the spinning machine 2, spun yarn is wound onto a bobbin which is rotating together with a spindle, while a fresh bobbin 12 is held on a peg 10. When a full bobbin is obtained, the operation of the spinning machine 2 is stopped, and a signal is preferably provided by a suitable means on the spinning machine for starting the doffing and donning operations. When an auto-doffer 1 receives such a signal from the spinning machine 2, the doffer begins to move along the spinning machine 2, and then stops at a position just in front of the spindles for doffing the full bobbins therefrom as shown in FIG. 3*a*. The cop holders (56, 57) of the doffing head 50 of the doffing device 11 are situated at a height corresponding to the top of a full bobbin 8, while the cop holders (56, 57) of the donning head 150 of the donning device 111 are situated at a height corresponding to the top of a fresh bobbin 12. Furthermore, both heads are respectively situated in their rearmost positions, which positions will be hereinafter referred to as the initial positions. It is also possible to use the signal, which is produced from a stopping device (not shown) of the auto-doffer and which indicates that the doffer is stopped at the above-mentioned position, to activate a device which can be used to feed a high-pressure liquid into a hydraulic cylinder 21 from a high-pressure liquid source (not shown). As a result, the piston rod 21*a* is caused to project from the cylinder 21. The projection of the piston rod 21*a* causes the arm 20 to be turned toward the left direction of FIG. 2. Therefore, the horizontal shaft 16 is turned toward the arrow encircling the shaft as shown in FIG. 2, via the bevel gears 17, 19 and the vertical shaft 18, thereby causing the vertical spline shaft 15*a* of the doffing device 11 and also the vertical spline shaft 115*a* of the donning device 111 to turn both shafts in the same direction via the bevel gears 23*a*, 24*a*, the shaft 25*a* and the three sector gears 26a, 27a, 28a, while the vertical spline shaft 15b of the doffing device 11 and the vertical spline shaft 115b of the donning device 111 are turned in a direction which is opposite to the direction of the turning of the vertical spline shafts 15a and 115a, via the bevel gears 23b, 24b, the shaft 25b and three sector gears 26b, 27b and 28b. The turning of the vertical spline shafts 15a and 15b, as mentioned above, causes the swing arms 30a and 30b of the doffing device 11 to swing, which movement in turn causes the doffing head 50 to be moved horizontally toward its foremost position. The turning of the vertical spline shafts 115a and 115b, which causes the swing arms 130a and 130b of the donning device 111 to swing, also moves the donning head 150 horizontally toward its foremost position.

The horizontal movement of the doffing head 50 as well as the horizontal movement of the donning head 150 is continued until all of the cop holders 56, 57 of the heads arrive at a position where the cop holders coincide with the axes of the spindles 9 or with the axes of the pegs 10, as shown in FIG. 3b. This position will hereinafter be referred to as the foremost position. When a limit switch 22b detects the condition wherein the cop holders of the doffing head 50 as well as the cop holders of the donning head 150 have reached their foremost positions, then all of the hydraulic cylinders 60 are activated simultaneously to receive a high-pressure liquid, as shown in FIG. 9. This means that each unit of the cop holders 56 and 57 is able to firmly hold the top of the full bobbin 8 or the top of the fresh bobbin 12 by means of the holding force produced by means of the hydraulic cylinders, wherein each of the units consists of the piston rods 62a, 62b, the pawl 54 with the acting arm 58, as well as the sector gear 51, and another finger 55 with a sector gear 52. Thereafter, by the signal generated from the sequential programming member of an electrical control device (not shown), high-pressure liquid can be fed into the hydraulic cylinder 78 as well as into the hydraulic cylinder 178. Consequently, by the downward projection of the piston rod 78a of the doffing device 11 as well as by the downward projection of the piston rod 178a of the donning device 111, the doffing head 50 which is already holding the full bobbin 8 by means of cop holders 56, 57 and the donning head 150 which is already holding the fresh bobbin 12 by means of cop holders 56, 57 are simultaneously moved upwardly. As a result, the full bobbin is doffed from the spindle 9, and the fresh bobbin 12 is removed from the peg 10. By using a combination of the connecting piece 73a, as shown in FIG. 2, and the limit switch 86, and also by using a combination of the connecting piece 173a and the limit switch 188, the condition wherein the doffing head 50 as well as the donning head 150 is lifted by a given distance can be detected and stopped. As the same time, by the operation of the hydraulic cylinder 21, the heads 50 and 150 are simultaneously moved horizontally toward their rearmost positions, respectively, by the reverse turning of the horizontal shaft 16, the vertical spline shafts 15a, 15b, 115a, 115b and also by the reverse turning of the swing arms 30a, 30b as well as of the swing arms 130a, 130b. Accordingly, the doffing head 50 together with the full bobbins 8 as well as the donning head 150 together with the fresh bobbins 12 can enter into its rearmost position as shown in FIG. 3c, and this condition can be detected by the limit switch 22a. Such detection by means of the limit switch 22a, is used for stopping the operation of the hydraulic cylinder 21. Furthermore, such detection is, also used for starting the operation of the hydraulic cylinder 78 to move the doffing head 50 downwardly and for starting the operation of the hydraulic cylinder 178 to move the donning head 150 upwardly. The downward movement of the doffing head 50 is allowed to continue until the limit switch 88 is actuated by means of the connecting piece 73a, while the upward movement of the donning head 150 is also allowed to continue until the limit switch 186 is actuated by the connecting piece 173a, as shown in FIG. 3d. When the donning head 150 reaches its rearmost position as shown in FIG. 3c, the light source 97 of the detecting device 90 will begin to emit a light beam toward the photocell 98, due to the signal transmitted from the limit switch 22a. When the fresh bobbins 12 are held by all of the cop holders 56, 57 in the donning head 150, the light beam which was previously interrupted by the intersecting arms 46 is allowed to enter into the photocell 98 as a result of the turning of the detecting members 44, which in turn causes the members 44 to be pushed down by the bottoms of the fresh bobbins 12. Thus, the upward movement of the donning head 150 can be commenced, as shown in FIG. 3d. If any of the fresh bobbins 12 are not held by any of the cop holders on the donning head 150, it will then be impossible for the corresponding detecting member 44 to be turned by any of the fresh bobbins 12. As a result of this condition, the light beam emerging from the light source 97 cannot be received by the photocell 98. Moreover, further operations of the auto-doffer are prevented from being carried out while this condition exists due to the unheld fresh bobbins and the thus interrupted light beam.

Similarly, when the doffing head 50 is lowered to a position as shown in FIG. 3d, the bottom of the full bobbin 8 held by the cop holders of the doffing head 50 pushes the wings 94c downwardly, thus permitting the light beam to reach the photocell and to indicate that all of the full bobbins 8 are being held by the cop holders of the doffing head 50.

As described above, since all of the detecting members can be pushed downwardly by all of the fresh bobbins held on the donning head or by all of the full bobbins held on the doffing head, successive operations of the auto-doffer can then be carried out. After such detection of the full bobbins by means of the detecting members 44 is completed, the horizontal movement of the doffing head 50 as well as the horizontal movement of the donning head 150 is carried out by the operation of the hydraulic cylinder 21. The horizontal movement of the donning head 150 is continued until the cop holder on the head arrives at the position where the cop holder coincides with the axis of a spindle 9, while the horizontal movement of the doffing head 50 is continued until the cop holder on the head arrives at the position where the cop holder coincides with the vertical axis of the peg 10. This condition can be detected by the limit switch 22b when it is actuated by the piston rod 21a. The result of such detection can be used for stopping the operation of the hydraulic cylinder 21.

The result of such detection can also be used to actuate the operations wherein fresh bobbins are simultaneously donned onto the spindles by means of the donning head 150, and wherein full bobbons 8 are simultaneously deposited onto the pegs 10 by means of the doffing head 50 due to the operations of the hydraulic cylinders 78 and 178, respectively, as shown in FIG. 3e.

Completion of the donning operation by means of the donning head is confirmed by the limit switch 187 which is actuated by the action of the connecting piece 173*a*, as shown in FIG. 2. Whereas, completion of the doffing operation by means of the doffing head is confirmed by the limit switch 89 which is actuated by the action of the connecting piece 73*a*. After the above-described confirmation process by the two switches 89 and 187 is completed, then, high-pressure liquid is simultaneously discharged from all of the hydraulic cylinders 60, whereby the holding process of bobbins by the cop holders is released.

When release of all of the full bobbins or all of the fresh bobbins by the cop holders is confirmed by means of an electrical control device (not shown), a signal generated by such device is used for simultaneously starting the horizontal movements of the doffing head 50 and of the donning head 150 toward their respective rearmost positions.

When the doffing head 50 as well as the donning head 150 is situated at its rearmost position, the limit switch 22*a* is actuated by the piston rod 21*a*, which in turn stops the operation of the hydraulic cylinder 21. The result of such detection by the limit switch 22*a* can be used for starting the operation of the hydraulic cylinder 78 whereby the doffing head 50 is lifted until the limit switch 87 is actuated by the connecting piece 73*a*. The result of such detection can also be used to start the operation of the hydraulic cylinder 178 whereby the donning head 150 is lowered until the limit switch 188 is actuated by the connecting piece 173*a*.

As a result a given number of full bobbins 8 can be completely doffed from the spindles 9, while the same number of fresh bobbins 12 is donned onto the bobbins 9, as shown in FIG. 3*f*.

By the respective movements of the doffing devices 50 and of the donning device 150 toward their initial positions, as shown in FIG. 3*a*, one cycle of the doffing and donning operations of this doffer is completed. After the doffing head 50 and the donning head 150 return to their respective initial positions, the auto-doffer 1 then moves to the next position along the spinning machine 2. Accordingly, the cycle is repeated as described above until all of the spindles within one row on the housing machine 2 are completely donned with fresh bobbins.

This auto-doffer 1 is provided with an electric wiring for stopping the succeeding operations when the detecting device 90 detects the condition wherein some of the bobbins are not being held by the cop holders. The auto-doffer 1 is also provided with a hydraulically-controlled unit contained in a high-pressure hydraulic generating device for controlling the supply of necessary high-pressure liquid to any of the hydraulic cylinders. This auto-doffer is further provided with a sequential programming device of a conventional mechanism for controlling an electrically-controlled device (not shown) which cooperates with several micro-switches, a light-source, a photocell and a hydraulic pressure control unit.

The embodiment of the present invention mentioned above has the following advantages.

In this embodiment, failure of the cop holders to hold any of the bobbins can be completely prevented, because the holding action of the cop holders 56, 57 is very reliable due to the fact that the two pistons of the embodiments exhibit a holding force produced by the hydraulic cylinder 60. Furthermore, the holding force of the cop holder 56 cannot be affected by the force of the adjacent cop holder 57.

A horizontally moving device 40 of the doffing device 11 and a horizontally moving device 140 of the donning device 111 are moved synchronously by means of one hydraulic cylinder 21 in such a way that when the right-hand vertical spline shaft and the left-hand vertical spline shaft in FIG. 2 are turned simultaneously and the corresponding swing arms are swung simultaneously, the doffing head 50 and the donning head 150 can be moved close to or far from the row of spindles.

When a doffing head 50 or a donning head 150 is in its rearmost position, since the rear side of the head is situated farther from the side of the spinning machine than any other members used in the doffing device 11 as well as in the donning device 111, this rear side can therefore be defined as the occupied area of the auto-doffer 1. It is preferable that the area occupied by the auto-doffer 1 of the present invention be narrow in the widthwise direction. In accordance with FIGS. 5 and 8, which show the respective initial positions of the doffing head 50 and of the donning head 150, since both heads are housed within the walls of the auto-doffer 1, the auto-doffer 1 can be brought as close as possible to the side of the spinning machine by leaving a narrow space between the auto-doffer and the spinning machine.

In this embodiment, the horizontally moving devices for both doffing and donning heads, the vertically moving devices for both doffing and the donning heads and the cop holders on the two heads are moved or operated by hydraulic cylinder mechanisms, respectively. Consequently, it is easy to accurately control the operations of the hydraulic cylinders as mentioned above. Since only one small hydraulic generating device is necessary per one auto-doffer, the dead weight of the auto-doffer is reduced.

Because the embodiment of the present invention utilizes an arrangement which consists of a hydraulic cylinder, chain pulleys and chains of the vertical movement initiating devices 85 and 185 and which causes a chain or chains to move twice the distance of the movement of the piston of the hydraulic cylinder, a short hydraulic cylinder can be used for initiating the necessary vertical movement of the doffing or donning heads.

Due to the detecting device 90 being arranged on the auto-doffer of the present invention, failure of the cop holders to hold any of the bobbins can be detected by this device, which is disposed midway of the travelling passage of the doffing head and also disposed midway of the travelling passage of the donning head. The result of such detection can be used for stopping the auto-doffer operation to prevent the auto-doffer from being damaged.

In the above-mentioned embodiment, the doffing device 11 for doffing a full bobbin 8 is disposed farther from the row of spindles than the donning device 111 for donning a fresh bobbin 12. The present invention, however, is not restricted to this arrangement.

Furthermore, in the spinning machine, it is not a requirement to dispose each of the pegs 10 on the vertical axis of each spindle as shown by the drawings of the above-described embodiment. If two separate devices are used for a modified auto-doffer, i.e. a horizontally moving device 40 of the doffing head and a horizontally moving device 140 of the donning head, the disposition of the peg with respect to the spindle is not restricted to the arrangement provided by the present embodiment.

In addition, if a row of pegs is constructed so that it can be moved longitudinally along the spinning machine, the fresh bobbins mounted on the pegs can be conveyed to their respective given positions. Furthermore, the full bobbins inserted on the pegs can be conveyed to the area located outside of the spinning machine. In this case, the operations of the present invention are more effective than these of the above-described embodiment.

Moreover, in the above-described present embodiment, the drive means of the horizontally moving device, vertical movement initiating device, and cop holders are all required to be operated by a plurality of hydraulic cylinders. However, such cylinders for operating the above-mentioned devices are not required in the construction of the present invention. Accordingly, electrical means as well as mechanical means can be effectively used in place of hydraulic means.

What is claimed is:

1. A mobile type auto-doffer movable along a spinning machine or the like having a row of pegs disposed between a spindle rail and floor surface of a spinning plant for doffing a plurality of full bobbins simultaneously from a row of spindles on said machine when said doffer is positioned and rested at the front of said full bobbins, and for donning same number of fresh bobbins conveyed from said row of pegs when said doffer is positioned and rested at the front of said fresh bobbins, said doffer having walls and comprising a doffing device; a donning device, and driving means for both doffing and donning devices, said doffing device comprising:

a doffing head provided with a given number of cop holder means;

two pinions rotatably mounted on both sides of said doffing head;

a pair of rack bars arranged in parallel, said bars always meshing with said pinions, and being guided and supported on said head;

two vertical spline shafts supported on said walls of said doffer; and a pair of swing arms connected angularly with said two vertical spline shaft supported on the walls of said doffer, respectively, said arms being able to slide on said vertical spline shafts and each of said rack bars being pivotably mounted on each of said swing arms;

and said driving means comprising:

means for inducing horizontal movement of said doffing head and said donning head which consist of two pairs of vertical spline shafts, one of said pair being located farther from the row of spindles than the other pair, and each shaft within each pair being disposed outside of each of the two end faces of said doffing or donning head, respectively; and a common driving mechanism, so that both vertical spline shafts within one pair can be rotated simultaneously around their axes in opposite directions; and means for inducing vertical movement of said doffing or donning head along said vertical spline shaft, said vertical movement resulting from sliding movement of said swing arms of said doffing and donning device.

2. A mobile type auto-doffer as claimed in claim 1, wherein said means for inducing horizontal movement of said doffing head and said donning head comprises:

a pair of follower gears of same diameter and fixedly mounted on said vertical spline shafts for said doffing device, and also another pair of follower gears of same diameter, said diameter being different from the diameter of said follower gears of said doffing device, said second pair of follower gears being fixedly mounted on said vertical spline shafts for said donning device; and a pair of driving gears of same diameter which are driven by a common driving shaft, so that all of said vertical spline shafts for both devices can be rotated simultaneously.

3. A mobile type auto-doffer as claimed in claim 2, wherein said auto-doffer further comprises:

a hydraulic cylinder for turning said common driving shaft in opposite directions.

4. A mobile type auto-doffer as claimed in claim 1, wherein said means for inducing horizontal movement of said doffing head and said donning head comprises:

swing arms for said doffing head, said arms having an arm length which is different from the arm length of swing arms for said donning head;

two pairs of follower gears of same diameter, each pair being fixedly mounted on said vertical spline shafts for said doffing device and for said donning device, respectively; and a pair of driving gears of same diameter driven by a common driving shaft, so that all of said vertical spline shafts for both devices can be rotated simultaneously.

5. A mobile type auto-doffer as claimed in claim 4, wherein said auto-doffer further comprises:

a hydraulic cylinder which can turn said common driving shaft in opposite directions.

6. A mobile type auto-doffer as claimed in claim 1, wherein said means for inducing vertical movement of said doffing head and said donning head comprises:

a vertical movement inducing device having an upper side chain wheel and a lower side chain wheel, both said wheels being arranged on the axis of a supporting member, said member moving along its passage parallel to said vertical spline shafts by means of a driving source;

an upper chain wheel rotatably mounted on the top wall of said doffer, and a lower chain wheel rotatably mounted on the bottom wall of said doffer; and a pair of chains, one of which being extended over said upper chain wheel and said upper side chain wheel on said vertical movement inducing device with one end of said chain being connected to said swing arm while the other end of said chain is connected to the upper wall of said doffer, and said other chain being extended over said lower chain wheel and said lower chain wheel on said vertical movement inducing device with one end of said chain being also connected to the same swing arm while the other end of said chain is connected to the bottom wall of said doffer.

7. A mobile type auto-doffer as claimed in claim 6, wherein said auto-doffer further comprises:

a driving source for vertically moving a chain wheel supporting member which is moved by a piston of a hydraulic cylinder for initiating movement of said member along the passage parallel to said vertical spline shaft.

8. A mobile type auto-doffer as claimed in claim 1, wherein each of said cop holder means consists of a plurality of cop holder sets, each cop holder set comprising:

two cop holders, and a hydraulic cylinder with two pistons arranged on both ends of said cylinder, respectively;

each of said cop holders having an external finger and an internal finger, and said external finger having an extended arm, to which said piston of said hydraulic cylinder is operationally connected, so that both external fingers of one set of cop holders can be operated simultaneously by means of said hydraulic cylinder.

9. A mobile type auto-doffer as claimed in claim 8, wherein said auto-doffer further comprises:

a pair of gears, one of said gears being mounted on said external finger, the other of said gears being mounted on said internal finger and said pair of gears always meshing with each other.

* * * * *